US008135584B2

(12) United States Patent
Geiser et al.

(10) Patent No.: US 8,135,584 B2
(45) Date of Patent: Mar. 13, 2012

(54) METHOD AND ARRANGEMENTS FOR CODING AUDIO SIGNALS

(75) Inventors: Bernd Geiser, Aachen (DE); Peter Jax, Hannover (DE); Stefan Schandl, Vienna (AT); Herve Taddei, Bonn (DE)

(73) Assignee: Siemens Enterprise Communications GmbH & Co. KG, Munich (DE)

( * ) Notice: Subject to any disclaimer, the term of this patent is extended or adjusted under 35 U.S.C. 154(b) by 830 days.

(21) Appl. No.: 12/223,359

(22) PCT Filed: Jan. 31, 2006

(86) PCT No.: PCT/EP2006/000811

§ 371 (c)(1),
(2), (4) Date: Jul. 29, 2008

(87) PCT Pub. No.: WO2007/087823

PCT Pub. Date: Aug. 9, 2007

(65) Prior Publication Data

US 2009/0012782 A1 Jan. 8, 2009

(51) Int. Cl.
*G10L 19/00* (2006.01)

(52) U.S. Cl. ..... 704/219; 704/222; 704/223

(58) Field of Classification Search ..... 704/219, 704/222, 223

See application file for complete search history.

(56) References Cited

U.S. PATENT DOCUMENTS

| | | | | |
|---|---|---|---|---|
| 5,623,575 | A * | 4/1997 | Fette et al. | 704/265 |
| 6,047,254 | A * | 4/2000 | Ireton et al. | 704/209 |
| 2009/0012782 | A1 * | 1/2009 | Geiser et al. | 704/223 |

FOREIGN PATENT DOCUMENTS

| | | | |
|---|---|---|---|
| CN | 1297222 | A | 5/2001 |
| EP | 0 883 107 | A1 | 12/1998 |
| EP | 1089258 | A2 | 4/2001 |

OTHER PUBLICATIONS

Hongmei Al et al: "A 6.6 kb/s CELP speech coder: high performance for GSM half-rate system"; ISSIPNN '94. 1994 International Symposium on Speech, Image Processing and Neural Networks Proceedings (Cat. No. 94TH0638-7) IEEE New York, NY, USA; vol. 2, 1994, pp. 555-558, XP002382323, ISBN: 0/7803-1865-X.

Choi J: "A Fast Determination of Stochastic Excitation without Codebook Search in CELP Coder"; IEEE Transactions on Speech and Audio Processing, IEEE Service Center, New York, US; vol. 3, No. 6, Nov. 1995, pp. 473-480, XP0007306333, ISSN. 1063-6676.

Salami R A: "Binary Code Excited Linear Prediction (BCELP): New Aproach to Celpcoding of Speech Without Codebooks" Electronics Letters, IEE Stevenage, GB, vol. 25, No. 6, Mar. 16, 1989, pp. 401-403 XP000096828 ISSN: 0013-5194.

* cited by examiner

*Primary Examiner* — Daniel D Abebe

(57) ABSTRACT

According to the invention, an excitation signal is generated as a result of sampled excitation values in order to excite an audio synthesis filter, the generated sampled excitation values being continuously stored in an adaptive codebook. A noise generator is provided which continuously generates random sampled values. A sequence of the stored sampled excitation values is selected from the adaptive codebook based on a fed audio fundamental frequency parameter by means of which a time gap between the sequence that is to be selected and the actual time reference is predefined. The excitation signal is generated by mixing the selected sequence with a random sequence encompassing actual random sampled valued of the noise generator.

15 Claims, 3 Drawing Sheets

METHOD AND ARRANGEMENTS FOR CODING AUDIO SIGNALS

CROSS REFERENCE TO RELATED APPLICATIONS

This application is the US National Stage of International Application No. PCT/EP2006/000811, filed Jan. 31, 2006 and claims the benefit thereof, which is incorporated by reference herein in their entirety.

FIELD OF THE INVENTION

The invention relates to a method and arrangements for coding audio signals. In particular the invention relates to a method and an excitation signal generator for forming an excitation signal to excite an audio synthesis filter as well as an audio signal encoder and an audio signal decoder.

BACKGROUND OF THE INVENTION

In many modern communication systems and in particular in mobile communication systems only limited transmission bandwidths are available for real-time audio transmissions, such as voice or music transmissions for example. In order to transmit as many audio or voice channels as possible in real time by way of a transmission link with limited bandwidth, as via a radio network for example, provision is therefore frequently made for compressing the audio signals to be transmitted by means of realtime-capable or quasi-realtime-capable audio coding methods.

With such audio coding methods the intention is generally to reduce the quantity of data to be transmitted and therefore the transmission rate as much as possible without having too great an adverse effect on the subjective audible impression or in the case of voice transmissions the comprehensibility.

Effective compression of audio signals is also an important aspect in relation to the storage or archiving of audio signals.

Coding methods, wherein an audio signal to be transmitted is aligned time frame by time frame with an audio signal synthesized by means of an audio synthesis filter by optimizing filter parameters, prove to be particularly effective. Such a procedure is frequently also referred to as analysis by synthesis. The audio synthesis filter is hereby excited by an excitation signal that is preferably likewise to be excited. Filtering is frequently also referred to as formant synthesis. The filter parameters used can for example be what are known as LPC coefficients (LPC: Linear Predictive Coding) and/or parameters which specify a spectral and/or temporal envelope of the audio signal. The optimized filter parameters and parameters specifying the excitation signal are then transmitted time frame by time frame to the receiver, to form a synthetic audio signal there by means of an audio synthesis filter provided on the receiver side, said synthetic audio signal being as similar as possible to the original audio signal in respect of the subjective audible impression.

Such an audio coding method is known from the ITU-T recommendation G.729. A realtime audio signal with a bandwidth of 4 kHz can be reduced to a transmission rate of 8 kbit/s by means of the audio coding method described there. According to the G.729 recommendation the excitation signal is generated by means of a so-called adaptive code book in conjunction with a so-called fixed code book. A plurality of predetermined excitation signal sequences are permanently stored in the fixed code book and can be retrieved using a code book index. In contrast already generated excitation signal sequences are stored in the adaptive code book. A respective sequence of the excitation signal is generated by mixing a sequence from the adaptive code book with a sequence from the fixed code book. To optimize the excitation signal, for each time frame both the fixed and adaptive code books are searched for excitation signal sequences, which allow the best possible alignment of the synthetic audio signal with the audio signal to be transmitted. Information relating to access to the sequences found to be optimal from the fixed and adaptive code books is finally transmitted to the receiver as parameters specifying the excitation signal. At the receiver these parameters are used to reconstruct an excitation signal by means of a fixed and adaptive code book of the receiver.

The search through two code books to be carried out according to the G.729 recommendation for each time frame in real time however requires a significant computation outlay, necessitating complex processors.

It is also currently intended to synthesize an audio signal to be transmitted with a higher bandwidth to improve the audible impression. The expansion G.729EV of the G.729 recommendation currently under discussion attempts to expand the audio bandwidth from 4 kHz to 8 kHz.

Such a bandwidth expansion of the synthesized audio signal can be achieved by constructing a suitable excitation signal of higher bandwidth, for example 8 kHz, from a narrowband excitation signal, for example with a bandwidth of 4 kHz, in order to excite the audio synthesis filter over a broad band. Different procedures for forming such a broadband excitation signal are currently under discussion in this context. According to such discussion the broadband excitation signal can be generated by squaring the narrowband excitation signal in the time domain or by generating an expansion band by displacing or mirroring the frequency spectrum of the narrowband excitation signal. However said procedures distort the spectrum of the excitation signal anharmonically and/or a significant, audible phase error is caused in the spectrum.

SUMMARY OF THE INVENTION

The object of the present invention is to specify a method for forming an excitation signal for an audio synthesis filter, which allows a further reduction of the transmission rate and/or an improvement in the audible impression and a reduction of the computation outlay required for audio coding during audio signal transmissions. The object of the invention is also to specify an excitation signal generator for implementing the method and an audio signal encoder and an audio signal decoder.

This object is achieved by a method, an excitation signal generator an audio signal encoder and an audio signal decoder with the features of the claims.

Advantageous embodiments and developments of the invention are set out in the dependent claims.

With the inventive method for forming an excitation signal to excite an audio synthesis filter the excitation signal is formed as a series of sampled excitation values. Already formed sampled excitation values are hereby stored in a temporally continuous manner in an adaptive code book. A noise generator is also provided, which generates random sampled values continuously. A sequence of stored sampled excitation values is selected from the adaptive code book based on a supplied audio basic frequency parameter, which predetermines a time interval between the sequence to be selected and the current time reference. The excitation signal is formed by mixing the selected sequence with a random sequence containing current random sampled values of the noise generator.

Using the noise generator as the source of random sampled values means that it is possible to dispense with a fixed code book for filling the adaptive code book. Accordingly it is not necessary to provide or transmit code book indices for selecting predetermined sampled value sequences stored in a fixed code book. Since such code book indices for a fixed code book take up a significant proportion of the audio data to be transmitted with known methods, it is possible generally to reduce the transmission rate to a significant degree with the invention. The saved transmission bandwidth can be used correspondingly for other purposes or to enhance transmission quality.

The noise generator, which preferably generates an essentially white, spectrally flat noise, allows a noise component contained in audio signals or voice signals generally to be modeled better than by means of a fixed code book, which only contains permanently predetermined sampled value sequences. A harmonic fine structure of the audio or voice signals can in contrast be simulated well by the selection of a sampled value sequence from the adaptive code book as a function of the audio basic frequency parameter.

Since a noise generator can naturally be scaled easily to different frequency ranges, bandwidth expansions can be achieved with little outlay. Also the invention prevents a residual coding error being transmitted to an expansion band during bandwidth expansion.

The invention can be deployed advantageously both during encoding and during decoding of an audio signal. In the case of an audio signal encoder an inventive excitation signal generator can excite an audio synthesis filter, whose output audio signal is compared with a respectively current frame of the audio signal to be transmitted. The comparison of the current frame is preferably carried out for different selections of sequences of earlier sampled excitation values stored in the adaptive code book. The temporal position of the sampled value sequence within the adaptive code book, for which the comparison indicates optimal correspondence, can be expressed by a corresponding audio basic frequency parameter, which can then be transmitted to a receiver. A search through a further fixed code book and the additional transmission of code book indices are not necessary.

In the case of an audio signal decoder a respectively received audio basic frequency parameter can control an inventive excitation signal generator in such a manner that it generates an excitation signal corresponding harmonically to the audio basic frequency parameter, without relying on code book indices to be transmitted in addition. The excitation signal thus generated allows an audio synthesis filter to be excited in order to generate a synthetic audio signal, which very closely resembles the original audio signal in respect of audible impression.

This reduces both the necessary computation outlay at the audio signal encoder and the necessary transmission rate. Correspondingly it is possible generally to achieve a higher transmission quality and therefore an improved audible impression for the same transmission rate.

The audio synthesis filters at the audio signal encoder and/or audio signal decoder can be for example in the form of LPC filters, Wiener FIR filters, filters for forming a temporal or spectral envelope of the audio signal or a combination of said filters.

The inventive method can preferably be executed by a signal processor.

According to one advantageous embodiment of the invention the sampled excitation values and/or the random sampled values can be processed time frame by time frame, with the length of the selected sequence and/or the length of the random sequence corresponding to a predetermined length of a time frame.

According to one advantageous development of the invention, if the audio basic frequency parameter predetermines a time interval, which is not a whole-number multiple of a predetermined sampling interval of a narrowband excitation signal to be generated separately, provision can be made to insert intermediate sampled values between the sampled excitation values and/or between the random sampled values as a function of the audio basic frequency parameter. Insertion preferably takes place in such a manner that a sampling interval of the resulting sampled values is smaller than the sampling interval of the narrowband excitation signal. It is thus possible to generate an excitation signal, which has additional frequency components of an expansion band, e.g. from 4-8 kHz compared with a narrowband excitation signal, for example in the frequency range from 0-4 kHz. The excitation signal thus generated has no significant anharmonic distortion other than excitation signals generated by known bandwidth expansion methods.

According to a further embodiment of the invention the selected sequence can be amplified according to a first intensity parameter and/or the random sequence can be amplified according to a second intensity parameter during mixing. The first and second intensity parameters, as well as the audio basic frequency parameter, can preferably be derived from the audio signal to be transmitted and then be transmitted time frame by time frame.

The excitation signal can also be formed with a sampling interval that is smaller compared with a narrowband excitation signal to be generated separately, with the result that the excitation signal has additional frequency components of an expansion band compared with the narrowband excitation signal. In this instance the audio basic frequency parameter and the first and/or second intensity parameter can be derived from audio synthesis parameters, which are actually provided to generate the narrowband excitation signal. Similarly the audio basic frequency parameter and the first and/or second intensity parameter can be derived from a narrowband component of an audio signal to be transmitted.

The audio basic frequency parameter and the first and/or second intensity parameter can therefore be derived from narrowband audio parameters but can be applied to the expansion band. This is advantageous in that no additional audio synthesis parameters are required for bandwidth expansion of the excitation signal outside the audio synthesis parameters provided to generate the narrowband excitation signal. The audio synthesis parameters provided to generate the narrowband excitation signal can generally be provided by existing, narrowband audiocodecs, for example according to the G.729 recommendation.

With known narrowband transmission methods, such as according to the G.729 recommendation for example, the audio basic frequency parameter is frequently determined more accurately than corresponds to the sampling interval of the narrowband excitation signal. An accuracy of for example half or a third of a sampling interval is frequently provided. The audio basic frequency parameter provided for the narrowband excitation signal can thus generally be used directly or essentially unchanged to generate the bandwidth-expanded excitation signal.

The first and/or second intensity parameter can be derived respectively from the corresponding narrowband intensity parameters by applying a predetermined function, in order for example to emphasize a noise component rather than a harmonic component in the expansion band of an audio signal.

A component of the excitation signal ascribable to the expansion band can preferably be combined with the separately generated, narrowband excitation signal, in order to generate a broadband excitation signal, for example in the frequency range from 0 to 8 kHz, to excite the audio synthesis filter.

BRIEF DESCRIPTION OF THE DRAWINGS

An exemplary embodiment of the invention is described in more detail below with reference to the drawings containing schematic illustrations, in which.

DETAILED DESCRIPTION OF THE INVENTION

Figure 1:
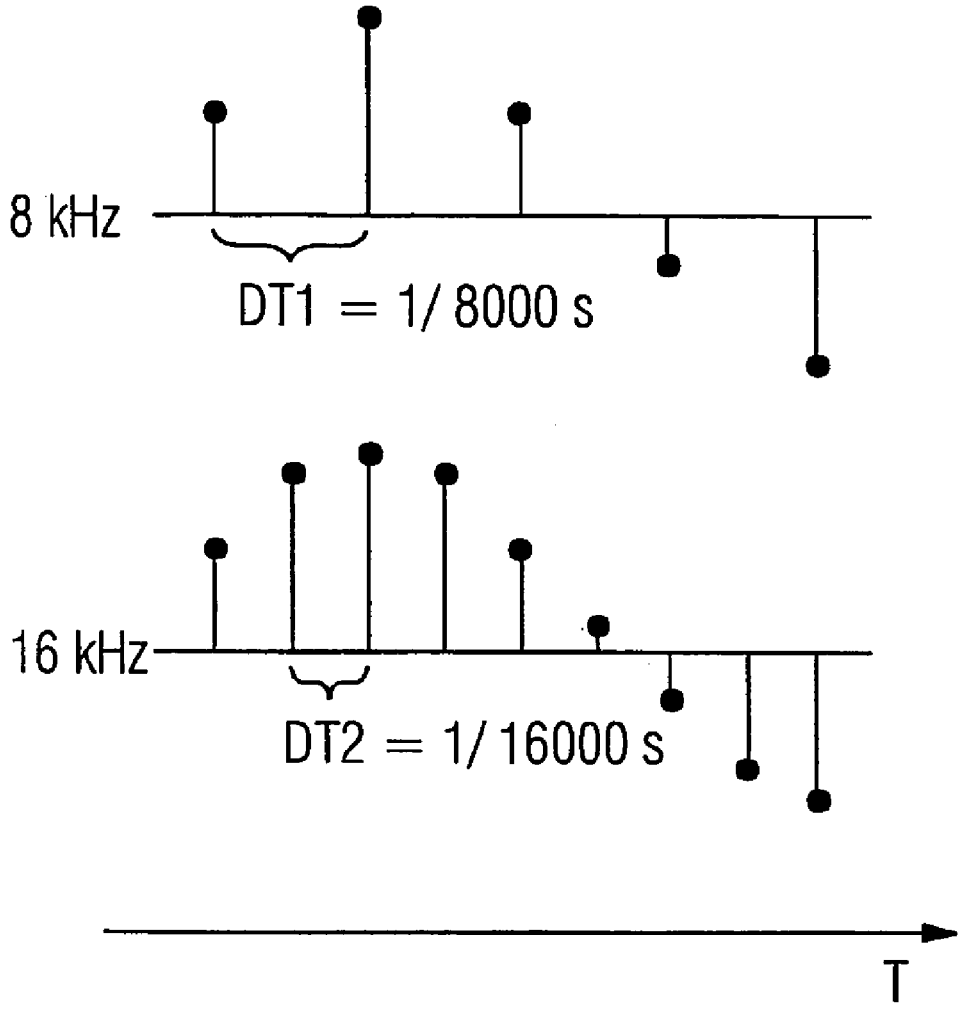
FIG. 1 shows an audio signal sampled at different sampling rates.

FIG. 1 shows an audio signal sampled at different exemplary sampling rates. Individual sampled values are shown here as dots, having different amplitudes shown by vertical lines. The different sampling rates are illustrated by different temporal sampling intervals between the sampled values. Both partial figures have a common time axis T.

The upper partial figure shows the audio signal sampled at a sampling rate of 8 kHz for example. The sampling rate of 8 kHz corresponds to a sampling interval DT1 of $1/8000$ s. Audio signals essentially up to a frequency of 4 kHz can be shown by the sampled values sampled at a sampling rate of 8 kHz according to a fundamental sampling theorem. This frequency range is hereafter referred to as narrowband.

The lower partial figure illustrates the audio signal sampled at a sampling rate of 16 kHz. In accordance with the sampling rate, which is double the sampling rate of the upper partial figure, the sampling interval DT2 in the lower partial figure is half the sampling interval DT1, in other words $1/16000$ s here. An audio signal essentially up to a frequency of 8 kHz can be shown by the sampled values sampled at a sampling rate of 16 kHz. The above frequency range is also referred to below as broadband. It is obvious that the terms narrowband and broadband are not limited to the frequency ranges simply given by way of example but can be applied generally to any frequency ranges, in so far as the term broadband is intended to specify a larger frequency range than the term narrowband.

Figure 2A:
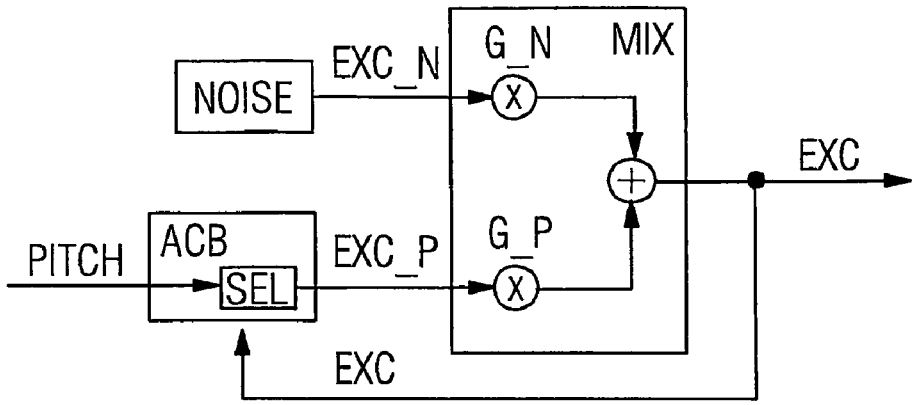
FIGS. 2*a* to 2*b* show different embodiments of an inventive excitation signal generator.
Figure 2B:
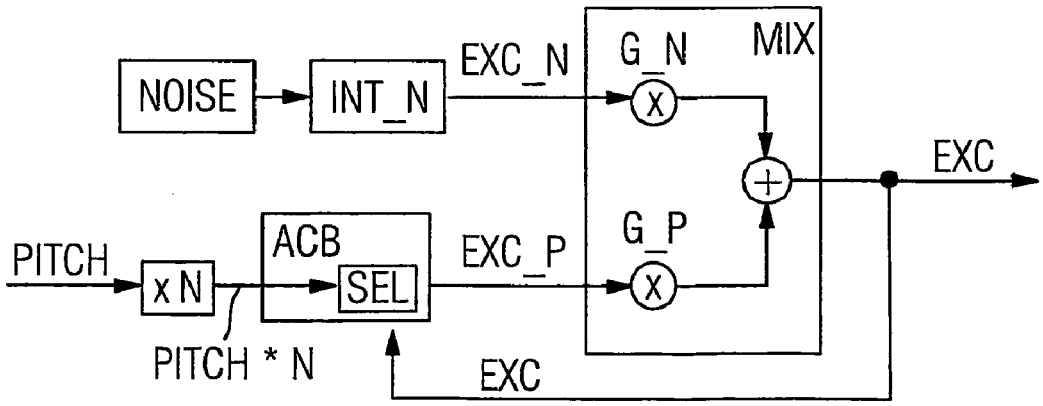

FIGS. 2*a* and 2*b* show schematic diagrams of different embodiments of an inventive excitation signal generator. The excitation signal generators shown respectively comprise a noise generator NOISE, an adaptive code book ACB and a mixing facility MIX as function components. The random generator NOISE serves to generate random sampled values with a respectively predetermined sampling interval in a temporally continuous manner. It should be assumed by way of example for both embodiments shown in FIGS. 2*a* and 2*b* that the respective noise generator NOISE generates random sampled values with a narrowband sampling rate, in other words 8 kHz for example. Random sampled values here are sampled values generated randomly or quasi-randomly by the noise generator in a temporally continuous manner, which are in particular not predetermined or selected from predetermined values. In particular the random sampled values are generated independently of an audio signal to be encoded or decoded by means of the respective excitation signal generator. Therefore it is not necessary to supply or transfer specific access parameters to operate the noise generator NOISE as it is with a fixed code book according to the prior art. In such a fixed code book permanently predetermined, deterministic sampled sequences are stored, for the time frame by time frame retrieval of which code book indices have to be supplied continuously, which generally takes up a significant proportion of the transmission bandwidth.

A noise signal formed by the random sampled values preferably has an essentially white or flat frequency spectrum.

Let us look first in the following at the embodiment of the excitation signal generator shown in FIG. 2*a*. The excitation signal generator shown there can generally be deployed for audio and/or voice coding. Both the noise generator NOISE and the adaptive code book ACB output sampled values time frame by time frame, in other words as a sequence of time frames of predetermined length containing sampled values. A time frame for example 5 ms long correspondingly contains 40 sampled values with a sampling rate of 8 kHz for example. With a sampling rate of 16 kHz such a time frame correspondingly contains 80 sampled values.

While the noise generator NOISE generates random sequences EXC_N, i.e. time frames with random sampled values, continuously, the adaptive code book ACB outputs sequences, i.e. time frames EXC_P of stored sampled excitation values, continuously. The random sequences EXC_N and the sequences EXC_P output by the adaptive code book ACB are routed to the mixing facility MIX, to which intensity parameters G_N for level control of the random sequences EXC_N and intensity parameters G_P for level control of the sequences EXC_P coming from the adaptive code book ACB are also routed time frame by time frame. In the mixing facility MIX the random sampled values of a respective random sequence EXC_N are multiplied, i.e. amplified, time frame by time frame by a respective intensity parameter G_N and the sampled values of a respective sequence EXC_P output by the adaptive code book ACB are multiplied, i.e. amplified, time frame by time frame by a respective intensity parameter G_P. The multiplications are shown in FIG. 2*a* by circles containing multiplication signs. The sampled value sequences amplified according to the intensity parameters G_N and G_P are added time frame by time frame by the mixing facility MIX and the resulting sum signal is output as the excitation signal EXC in the form of a series of sampled excitation values. The addition is shown in FIG. 2*a* by a circle containing a plus sign. The excitation signal EXC formed is output and stored in a temporally continuous manner in the adaptive code book ACB parallel to this. The excitation signal EXC is therefore fed back to a certain extent from the output of the mixing facility MIX to the adaptive code book ACB.

With regard to the excitation signal EXC the adaptive code book ACB acts as a shift register, in which currently formed sequences of the excitation signal EXC are stored, with previously formed sequences of the excitation signal being displaced successively backward whilst maintaining the temporal order.

The output of the sequences EXC_P of stored sampled excitation values is controlled by audio basic frequency parameters PITCH supplied time frame by time frame to the adaptive code book ACB. The audio basic frequency parameters PITCH are used to select the sequences EXP to be output by the adaptive code book ACB from the stored sampled excitation values. The selection is made by a selection facility SEL of the adaptive code book ACB. Such an audio basic frequency parameter PITCH is frequently also referred to in technical circles as pitch lag.

It should be assumed below that the audio basic frequency parameters PITCH are respectively predetermined in units of a narrowband sampling interval, here for example 1/8000 s with a narrowband sampling rate of 8 kHz. A period of a basic frequency of the audio signal to be transmitted or to be synthesized is specified respectively time frame by time frame by the audio basic frequency parameters PITCH. With modern audio coding methods, e.g. according to the G.729 recommendation, the basic frequency periods of an audio signal are frequently measured or provided with higher resolution than corresponds to a respectively used sampling interval. Such an audio basic frequency parameter, accurate to fractions of sampling intervals, can thus also have values that are not whole numbers in units of the sampling interval. Such an audio basic frequency parameter PITCH, which is not a whole number, contains information about higher frequency components than actually correspond to the sampling interval. While such higher frequency components are filtered out with known audio coders, for example according to the G.729 recommendation, the information about the higher frequency components can be used in a simple manner to improve audio synthesis quality with inventive audio signal generators.

Figure 3:
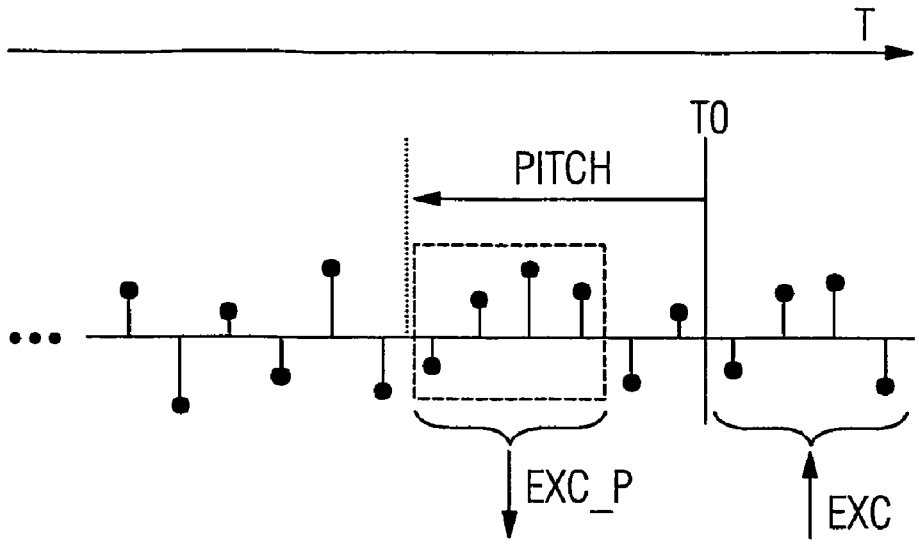
FIG. 3 shows a diagram of a selection process for a sampled value sequence from an adaptive code book.

FIG. 3 shows the selection of a sampled value sequence EXC_P from the adaptive code book ACB based on the audio basic frequency parameter PITCH supplied to the selection facility SEL. FIG. 3 shows a segment of the sampled excitation values stored in a temporally continuous manner in the adaptive code book ACB. The stored sampled excitation values are shown by dots with vertical lines, with the length of a respective line illustrating a respective amplitude of a sampled excitation value. The temporal pattern is shown by a time axis T.

A current time reference T0 is shown in FIG. 3 by a vertical line, which indicates the point in the adaptive code book where a respective currently formed time frame of the excitation signal is stored for the first time in the adaptive code book ACB. Storage here takes place temporally or logically adjacent to a time frame of the excitation signal stored immediately beforehand. For the sake of clarity in FIG. 3 a time frame only contains four sampled values. A generalization of the relationships shown by FIG. 3 to time frames of any predetermined length is evident.

The sequence EXC_P of stored sampled excitation values, whose start has a time interval from the current time reference T0 corresponding to the audio basic frequency parameter PITCH and whose length corresponds to the predetermined length of a time frame, is selected from the adaptive code book ACB to be output. The time interval here is calculated temporally backward from the current time reference T0. It should be noted that the start of the selected sequence EXC_P does not have to coincide with a time frame limit but in some instances can coincide within predetermined limits with any stored sampled excitation value.

It is assumed by way of example in FIG. 3 that a time interval of six sampling intervals is specified by the audio basic frequency parameter PITCH transferred with the current time frame. A time frame from the sixth last sampled excitation value stored to the third last sampled excitation value stored, calculated from the current time reference T0, is output as the selected sequence EXC_P. The output time frame EXC_P is shown in FIG. 3 by a dashed rectangle.

When the inventive excitation signal generator is activated, the adaptive code book ACB is initially empty, then to be filled successively with formed sampled excitation values of the output excitation signal EXC. Since the adaptive code book ACB is empty at first, the excitation signal EXC is initially only supplied by the noise generator NOISE as the single signal source. This means that the adaptive code book ACB is first filled with non-periodic random sampled values. In this scenario the question arises as to how periodic signal components can be obtained by means of the adaptive code book ACB, since only a non-periodic noise generator NOISE is available as the original signal source. In fact it was deemed necessary according to former thinking to provide a fixed code book as well as an adaptive code book, in order to fill the adaptive code book ACB with determined signal sequences stored in the fixed code book.

According to research by the inventor however such a fixed code book is not necessary. In fact it is possible to generate an excitation signal with a harmonic fine structure by continuous appropriate selection of sampled value sequences EXC_P from the adaptive code book ACB even without a fixed code book. To clarify the underlying active principle, we will look at an instance where the audio basic frequency parameter PITCH remains constant over a number of time frames. In such an instance a time frame with the same temporal position relative to T0 is read out from the adaptive code book ACB a number of times in succession, mixed with a random sequence EXC_N of the noise generator NOISE and stored again as the current time frame of the excitation signal EXC in the current code book ACB. The current time frame is hereby stored with an interval specified by the audio basic frequency parameter PITCH in relation to the previously output sequence EXC_P. This causes a periodic signal component to form successively in the adaptive code book ACB, its period being determined by the audio basic frequency parameter PITCH. The periodic component of the overall excitation signal EXC is hereby controlled by the intensity parameters G_N and G_P.

Using the noise generator NOISE instead of a fixed code book means that it is not necessary to transmit code book indices for a fixed code book. This means that the transmission rate or bandwidth for the transmission of audio signals can be reduced significantly. Also using the noise generator NOISE allows a better audible impression to be achieved, particularly when playing back non-harmonic or noise-type audio components.

An embodiment of the inventive excitation signal generator for generating a bandwidth-expanded excitation signal EXC is described below with reference to FIG. 2*b*. The output excitation signal EXC is generated with a bandwidth expanded by a bandwidth expansion factor N. The reference characters also used in FIG. 2*a* retain their significance in FIG. 2*b*.

Let it be assumed by way of example that the bandwidth expansion factor N has a value of 2 and that with a narrowband sampling rate of 8 kHz the sampling rate of the excitation signal EXC to be output is correspondingly N×8 kHz=16 kHz.

While the noise generator NOISE outputs random sampled values with the narrowband sampling rate of 8 kHz, the adaptive code book ACB and the mixing facility MIX use the broadband sampling rate of 16 kHz. To adjust the narrowband sampling rate of the noise generator NOISE to the broadband sampling rate of the mixing facility MIX, an interpolator INT_N is connected between said mixing facility MIX and the noise generator NOISE. The interpolator INT_N receives the random sampled values output by the noise generator NOISE with a narrowband sampling rate and inserts an intermediate sampled value with amplitude 0 between two of these random sampled values respectively. For other values of the bandwidth expansion factor N, N−1 intermediate sampled values, each with amplitude 0, are inserted similarly between two random sampled values respectively. This converts a narrowband white noise spectrum of the noise generator NOISE to a broadband white spectrum.

Let it be assumed that the audio basic frequency parameter PITCH is supplied in units of the narrowband sampling interval. Let it be further assumed that the audio basic frequency parameter PITCH is provided in these units with an accuracy at least to the nearest fraction 1/N, in other words here to the nearest ½. The non-whole-number audio basic frequency parameter PITCH contains information about frequency components outside the narrowband frequency range. Such a non-whole-number audio basic frequency parameter PITCH is frequently also represented by pitch=p+p_frac/N, where p and p_frac are whole-number parameters with p_frac=0, . . . , N−1. Since the adaptive code book ACB uses a sampling interval that is halved or divided by N compared with the narrowband sampling interval, the audio basic frequency parameter PITCH is first multiplied by N. The resulting product PITCH×N=p×N+p_frac is then used to select the stored sampled value sequence EXC_P, as already explained in relation to FIG. 3.

The excitation signal generator shown in FIG. 2*b* can generate a bandwidth-expanded excitation signal EXC in a simple manner, the harmonic fine structure of said bandwidth-expanded excitation signal EXC being able to be modeled better in the expansion band by using the non-whole component of the audio basic frequency parameter PITCH. In particular the harmonic fine structure of the excitation signal in the narrowband frequency range can be continued harmonically and consistently into the expansion band.

Figure 4:
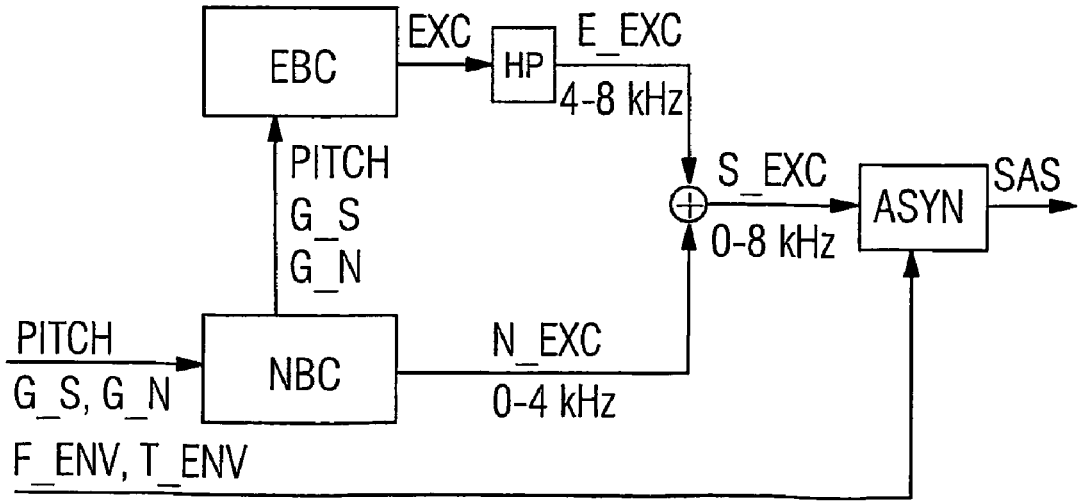
FIG. 4 shows an audio signal decoder.

FIG. 4 shows a schematic diagram of an inventive audio signal decoder for receiving an audio signal to be transmitted. The audio signal decoder comprises an audio synthesis filter ASYN, which is excited by a broadband excitation signal S_EXC, e.g. in the frequency range from 0 to 8 kHz and generates a synthetic audio signal SAS by filtering. Spectral parameters F_ENV, which specify a spectral envelope of the audio signal to be transmitted, as well as time pattern parameters T_ENV, which specify a temporal envelope of the audio signal, are supplied to the audio synthesis filter ASYN. The audio synthesis filter ASYN uses the supplied parameters F_ENV and T_ENV to form the spectral and temporal envelope of the audio signal SAS to be synthesized. The parameters F_ENV and T_ENV are determined time frame by time frame by the transmitter of the audio signal to be transmitted and are transmitted to the receiver or audio signal decoder.

Generation of the broadband excitation signal S_EXC is divided into different layers, namely one layer for the narrowband frequency range, in this instance from 0 to 4 kHz, and one layer for the expansion band, in this instance from 4 to 8 kHz. To generate a narrowband excitation signal N_EXC, in this instance in the frequency range from 0 to 4 kHz, the audio signal decoder has a narrowband excitation signal generator NBC and to generate a frequency-expanded excitation signal E_EXC, in this instance in the frequency range from 4 to 8 kHz, it has an excitation signal generator EBC according to FIG. 2*b* for the expansion band. The narrowband excitation signal generator NBC can be embodied like the inventive excitation signal generator shown in FIG. 2*a* or like a conventional excitation signal generator equipped with an adaptive and a fixed code book, e.g. according to the G.729 recommendation.

The audio basic frequency parameter PITCH and the intensity parameters G_N and G_P are supplied respectively to the narrowband excitation signal generator NBC time frame by time frame. A sum parameter G_S+G_N and a ratio parameter G_S/G_N or its core value can also be supplied instead of the intensity parameters G_N and G_P.

The audio basic frequency parameter PITCH is not a whole number as already described in conjunction with FIG. 2*b* and is defined by pitch=p+p_frac/N. The bandwidth expansion factor N has a value of N=2 by way of example corresponding to the bandwidth ratio between the broadband frequency range from 0 to 8 kHz and the narrowband frequency range from 0 to 4 kHz. The narrowband excitation signal generator NBC generates the narrowband excitation signal N_EXC based on the supplied parameters PITCH, G_S and G_N.

The parameters PITCH, G_S and G_N used by the narrowband excitation signal generator NBC are routed to the excitation signal generator EBC equipped according to FIG. 2*b*. The intensity parameters G_S and G_N are optionally converted by means of a predetermined function, before they are used in the mixing facility MIX of the excitation signal generator EBC for level control. The routed audio basic frequency parameters PITCH are multiplied by N, in this instance N=2, as shown in FIG. 2*b*, in order to select a stored excitation signal sequence from the adaptive code book of the excitation signal generator EBC. The excitation signal generator EBC uses the supplied parameters PITCH, G_S and G_N, as already described in conjunction with FIG. 2*b*, to generate the excitation signal EXC, which initially still has a bandwidth from 0 to 8 kHz. Since the excitation signal generator EBC is only intended to be responsible for the expansion band with the audio signal decoder shown, the excitation signal EXC is supplied to a high-pass filter HP. This essentially only allows frequencies of the expansion band from 4 to 8 kHz to pass and outputs a frequency-expanded excitation signal E_EXC. The frequency-expanded excitation signal E_EXC is combined with the narrowband excitation signal N_EXC, as shown in FIG. 4 by a plus sign, to form the broadband excitation signal S_EXC. The latter is finally supplied to the audio synthesis filter ASYN.

With the inventive audio signal decoder only the audio parameters PITCH, G_S and G_N are required to generate the bandwidth-expanded excitation signal E_EXC and therefore to generate the broadband excitation signal S_EXC and these are transmitted anyway to generate the narrowband excitation signal or are supplied by a narrowband excitation signal generator. The audio parameters PITCH, G_N and G_P can thus advantageously be derived from the narrowband frequency range of the audio signal to be transmitted or from parameters of a narrowband codec, in order then to be applied to an expansion band to be added. To generate the broadband excitation signal S_EXC no additional audio parameters have to be transmitted compared with generation of the narrowband excitation signal N_EXC. Dispensing with a fixed code book in the excitation signal generators EBC and/or NBC means that there is also no need for the additional transmission of code book indices. Additional information about an audio structure in the expansion band can be transmitted by the parameters F_ENV and T_ENV.

The audio signal decoder shown in FIG. 4 can be expanded to encompass an audio signal encoder according to the analysis by synthesis principle. The synthesized audio signal SAS is hereby compared by a comparison facility with the audio signal to be encoded and then aligned by varying the audio synthesis parameters PITCH, G_S, G_N, F_ENV and T_ENV. A combination of audio signal decoder and audio signal encoder is frequency also referred to as a codec.

The invention claimed is:

1. A method for generating an excitation signal to excite an audio synthesis filter, comprising:

temporally continuously storing sampled excitation values being already generated in an adaptive code book;

continuously generating random sampled values by a noise generator;

selecting a sequence of the sampled excitation values from the adaptive code book based on an audio basic frequency parameter that predetermines a time interval between a time of the sequence to be selected and current time; and generating the excitation signal by mixing the selected sequence of the sampled excitation values with a random sequence of the random sampled values containing random sampled values of the noise generator at the current time; and wherein if the audio basic frequency parameter is not a whole-number multiple of a sampling interval of a narrowband excitation signal to be generated, intermediate sampled values are inserted between the sampled excitation values or between the random sampled values as a function of the audio basic frequency parameter.

2. The method of claim 1 wherein the sampled excitation values or the random sampled values are processed time frame by time frame.

3. The method of claim 1 wherein a length of the selected sequence or a length of the random sequence corresponds to a predetermined length of a time frame.

4. The method of claim 1 wherein the insertion is carried out for providing a sampling interval of the sampled excitation values that is smaller than the sampling interval of the narrowband excitation signal so that the excitation signal has additional frequency components of an expansion band compared with the narrowband excitation signal.

5. The method of claim 1 wherein the excitation signal is combined with the narrowband excitation signal for generating a broadband excitation signal to excite the audio synthesis filter.

6. The method of claim 1 wherein:

the selected sequence is amplified according to a first intensity parameter during the mixing, or the random sequence is amplified according to a second intensity parameter during the mixing.

7. The method of claim 6 wherein a sampling interval of the sampled excitation values is smaller than the sampling interval of the narrowband excitation signal to be generated.

8. The method of claim 7 wherein the audio basic frequency parameter and the first intensity parameter or the second intensity parameter are derived from an audio synthesis parameter provided to generate the narrowband excitation signal.

9. The method of claim 7 wherein the excitation signal is combined with the narrowband excitation signal for generating a broadband excitation signal to excite the audio synthesis filter.

10. The method of claim 1 wherein if the audio basic frequency parameter is not a whole-number multiple of a sampling interval of a narrowband excitation signal to be generated, the intermediate sampled values are inserted between the sampled excitation values and wherein the intermediate sampled values are also inserted between the random sampled values as a function of the audio basic frequency parameter.

11. The method of claim 1 wherein if the audio basic frequency parameter is not a whole-number multiple of a sampling interval of a narrowband excitation signal to be generated, the intermediate sampled values are inserted between the sampled excitation values and wherein the method further comprises filtering the generated excitation signal.

12. The method of claim 1 wherein if the audio basic frequency parameter is not a whole-number multiple of a sampling interval of a narrowband excitation signal to be generated, the intermediate sampled values are inserted between the random sampled values as a function of the audio basic frequency parameter and wherein the method further comprises filtering the generated excitation signal.

13. An audio signal decoder for implementing the method of claim 1.

14. The method of claim 1 wherein the mixing of the selected sequence of the sampled excitation values with a random sequence of the random sampled values containing random sampled values of the noise generator at the current time is performed by at least one mixing facility or at least one mixing unit.

15. An audio signal encoder, comprising:

an excitation signal generator that comprises:

an adaptive code book that temporally continuously stores sampled excitation values being already generated, a noise generator that continuously generates random sampled values, a selection unit that selects a sequence of the sampled excitation values based on an audio basic frequency parameter that predetermines a time interval between a time of the sequence to be selected and current time, and a mixing unit coupled to the noise generator and the adaptive code book that generates an excitation signal by mixing the selected sequence of the sampled excitation values with a random sequence of the random sampled values containing random sampled values of the noise generator at the current time and outputs the excitation signal;

an audio synthesis filter to be excited by the excitation signal that generates a synthetic audio signal; and a comparison unit that aligns the synthetic audio signal with an audio signal to be transmitted; and wherein the noise generator is coupled to the mixing unit by an interpolator for inserting intermediate sampled values between the random sampled values.

* * * * *